United States Patent [19]

Carlson et al.

[11] 4,293,284

[45] Oct. 6, 1981

[54] POWER LIMITING CONTROL APPARATUS FOR PRESSURE-FLOW COMPENSATED VARIABLE DISPLACEMENT PUMP ASSEMBLIES

[75] Inventors: Allen J. Carlson, Tecumseh; Henry A. Vander Kaay, Ann Arbor, both of Mich.

[73] Assignee: Double A Products Company, Manchester, Mich.

[21] Appl. No.: 82,975

[22] Filed: Oct. 9, 1979

[51] Int. Cl.[3] ..... F04B 49/08

[52] U.S. Cl. ..... 417/218; 60/450

[58] Field of Search ..... 417/218, 222, 219; 60/445, 451, 452, 450

[56] References Cited

U.S. PATENT DOCUMENTS

| | | | |
|---|---|---|---|
| 3,067,693 | 12/1962 | Lambeck | 417/219 |
| 3,379,133 | 4/1968 | McCormick | 417/218 |
| 3,635,021 | 1/1972 | McMillen et al. | 417/222 X |
| 3,820,920 | 6/1974 | Klimaszewski et al. | 417/218 X |
| 4,067,664 | 1/1978 | Robeller | 417/218 |

*Primary Examiner*—Carlton R. Croyle
*Assistant Examiner*—Edward Look
*Attorney, Agent, or Firm*—Olsen and Stephenson

[57] ABSTRACT

Control apparatus 24 for use with a pressure-flow compensated variable displacement pump assembly 10 for saving energy by limiting the power output of the pump 12 to the load requirements, or to the pump drive capacity, comprising a pressure regulated variable orifice means 52 through which the pumped fluid to load flows, the orifice means being responsive to changes in pressure of the pumped fluid from the pump assembly to vary inversely the effective area of the orifice means, the flow compensator 28 of the pump assembly functioning to hold the pressure drop across the orifice means constant so that the flow across the orifice means also varies inversely with the pressure to limit to a preselected value the horsepower supplied by the pump assembly to load.

10 Claims, 3 Drawing Figures

Fig-1
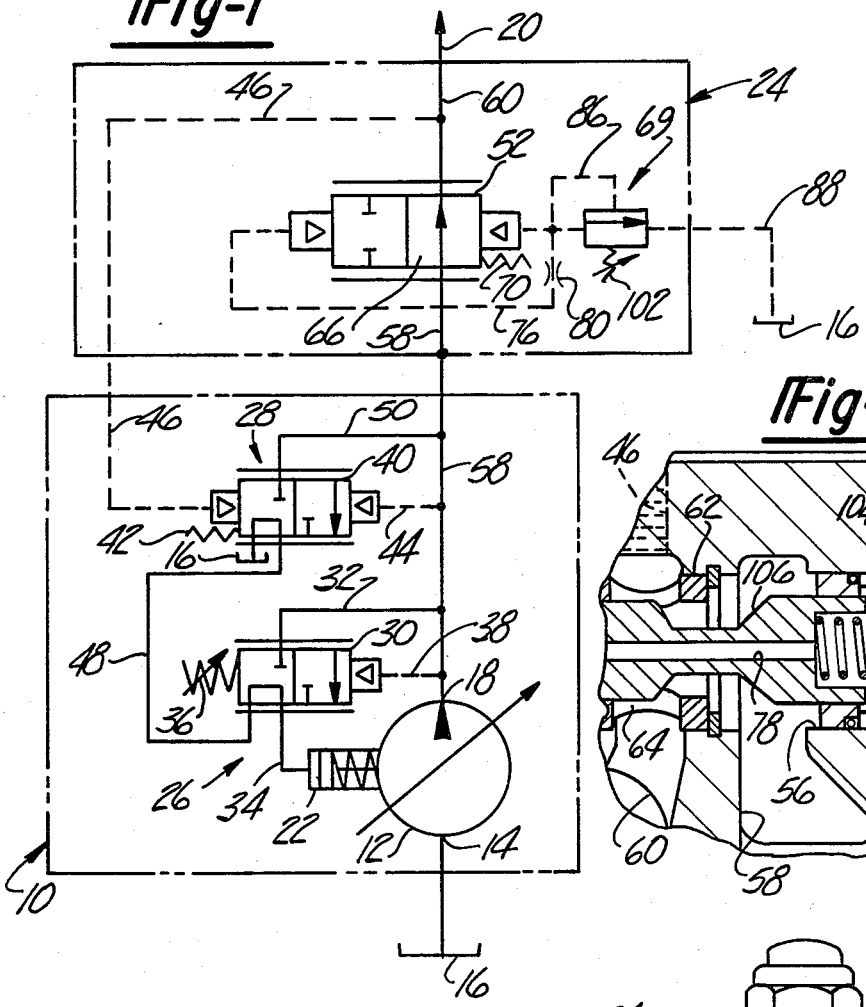
Fig-3
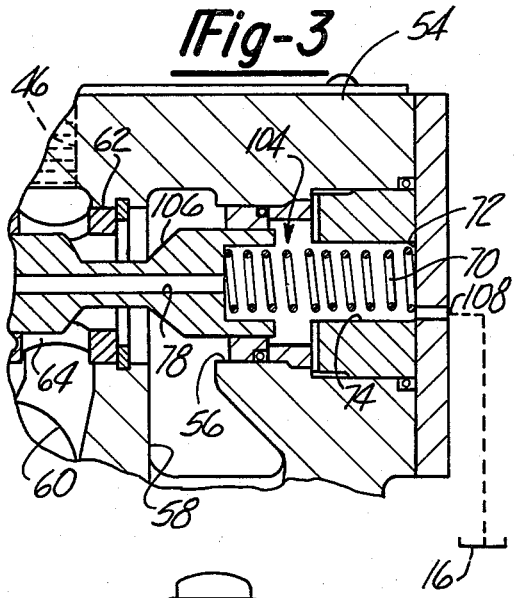
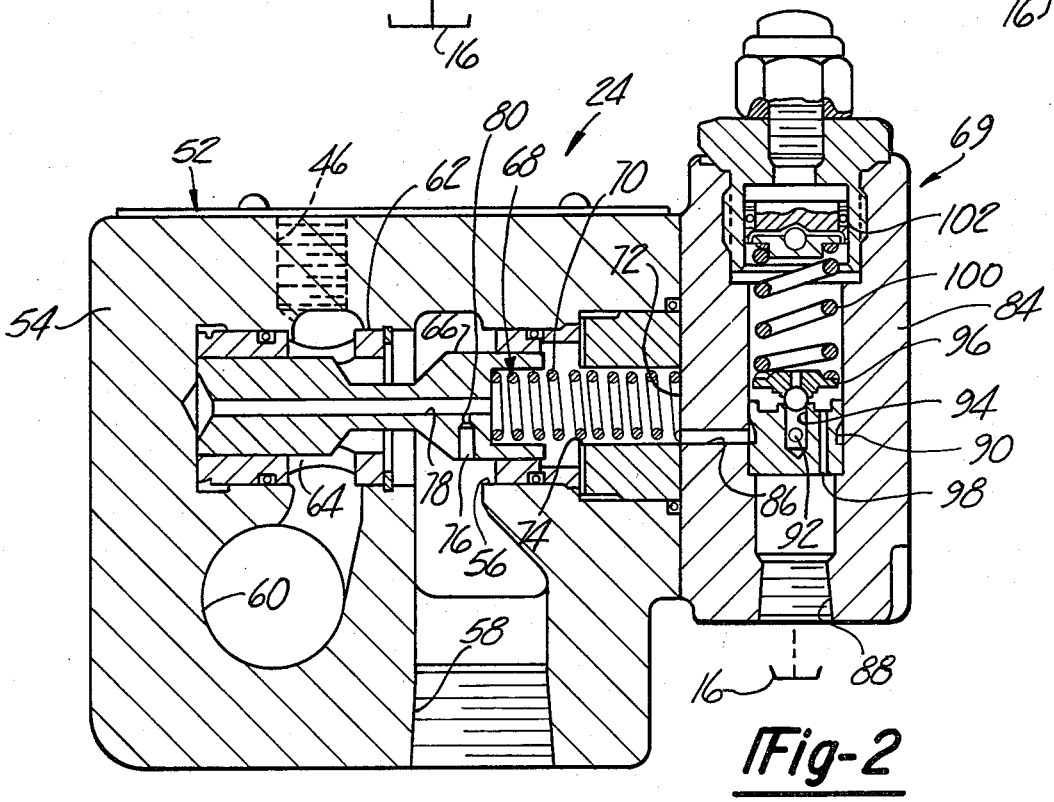
Fig-2

POWER LIMITING CONTROL APPARATUS FOR PRESSURE-FLOW COMPENSATED VARIABLE DISPLACEMENT PUMP ASSEMBLIES

TECHNICAL FIELD

The present invention relates to energy control apparatus for use in conjunction with a variable displacement pump for supplying hydraulic fluid in a system and wherein the output flow, pressure and power are limited to pump driver limitations so as to control maximum energy application. More specifically, the invention is directed to improved horsepower limiting control apparatus for use in conjunction with a pressure-flow compensating variable displacement pump assembly.

BACKGROUND ART

Automatically controlled variable displacement piston pumps that are sensitive to pressure control and flow control are well known in the art. Pumps of this character are produced, for example, by the Fluid Power Division of Cessna. In operation of these pumps, when the drive shaft of the piston pump is rotated by some external source of power, a piston block, which is splined to a drive shaft, also turns. The piston block contains a plurality of piston assemblies which have a free swiveling shoe swaged on the ball end of the piston assembly. The shoe end of the piston rides against a smooth surface of a camplate. When the camplate is in its neutral position the piston assemblies do not travel in and out of the piston block bores. They remain in a stationary position in relation to the piston block and rotate merely as an internal part of the piston block. When the camplate is in the neutral position no oil is being drawn into the pump and no oil is being discharged from the pump. The pump is then in a zero displacement position.

When the camplate is moved to any position from neutral up to a full cam angle, such as 17°, the piston shoes follow the inclined surface of the camplate and reciprocate in the piston block bores. Half of the piston assemblies are being pulled out of the piston block while the remaining half of the pistons are being pushed back into the piston block. This action causes the piston pump to pump oil, the pistons being pulled from the piston block to suck oil into the piston block bores through the suction port and an intake kidney slot. As the pistons cross over top dead center the pistons push the oil out of the piston block bores and into the pressure kidney slot and on out the pressure port. Each piston assembly completes the cycle each revolution of the pump shaft causing a continuous flow of oil from the pump. The greater the cam angle, the greater the piston stroke, the greater the piston stroke, the more oil is pulled into the pump and discharged out the pressure port.

Pressure compensator control apparatus and flow compensator control apparatus that provide system efficiency by matching both pressure and flow to load requirements are conventionally used in conjunction with variable displacement piston pumps of the foregoing character. When control apparatus of this type is used and when pressurized oil is required in the system, the flow of oil is regulated by the differential in pressure. When the pump is required to provide more flow to the system, the pressure in the pump pressure passage will drop slightly. This allows the oil from a camplate control piston of the pump to drain and the pump then increases its volume of discharge. When the flow is satisfied the pump camplate will stabilize in a position to provide the flow required. The flow rate of oil in the system is dictated by an orifice in a control valve. This orifice can be spool travel, a flow control valve or passage size. Whatever method is used, it is sized to provide the desired flow at a constant pressure drop across the regulating orifice. The pressure in the system is fed from the load down stream of the orifice back to the sensor port in the pump compensator. Since the strength of the flow compensator spring is set at a fixed amount, such as 200 P.S.I., the spring pressure plus the load pressure fed back to the compensator will require the pump to pump the flow rate of oil dictated by the size of the orifice at a constant pressure (200 P.S.I.) above the actual load pressure. The pump will then provide only the flow rate required at constant pressure (200 P.S.I.) above actual load pressure. The pump will thus automatically adjust to the varying pressure and flow demands of the system.

The known pressure and flow compensator control apparatus described above contributes significantly to the saving of energy in the system. A still further need in systems of this type, in addition to the savings associated with pressure and flow controls, is to provide horsepower limiting controls that limit the horsepower delivered by the pump to the amount of the pump driving means that is made available, which can be accomplished by reducing the pump output flow to meet the limitation of the driving means.

It is known to provide pump assemblies that have pressure and power controls, but in these known assemblies the power limiting controls are constructed within the pumps, resulting in especially built units that are costly, and the power limiting controls cannot be adapted for use with standardized pump assemblies having known pressure and flow compensator control apparatus. In the known power limiting controls, it is the conventional practice to employ pilot fluid in the pump assemblies for flow through a variable orifice for regulating the pump operation which results in a control system of considerabove complexity being built within the pump, and one which cannot be readily used with standard pump assemblies having known pressure and flow compensator control apparatus.

SUMMARY OF THE INVENTION

The present invention has overcome the inadequacies of the prior art and provides an improved horsepower limiting control apparatus to be used in conjunction with either a pressureflow or a flow compensated variable displacement pump assembly.

According to one form of the present invention, a horsepower limiting control apparatus is provided for use with a pressure-flow compensated variable displacement pump assembly that has a pressure compensator for limiting output pressure of the pumped fluid to the load to a pre-set value under stall or maximum load conditions and a flow compensator for sensing the load pressure of the fluid and for adjusting the displacement of the pump to whatever is required to maintain a constant pressure differential of the fluid of a selected magnitude across the horsepower limiting control apparatus. The horsepower limiting control apparatus comprises a pressure regulating variable orifice means through the orifice of which the pumped fluid flows to the load, the variable orifice means being responsive to changes in pressure of the pumped fluid from the pump assembly, which are due to variations in load resistance, to vary inversely the effective orifice area of the orifice means. This form of the invention includes both a pressure compensator and a flow compensator, but it is to be understood that the invention can be used with only a flow compensated variable displacement pump assembly. The flow compensator functions to hold the pressure drop across the orifice means constant so that the flow across the orifice means also varies inversely with the pressure of the pumped fluid from the pump assembly thereby to limit to a preselected value the horsepower supplied by the pump assembly to load. By virtue of this construction and arrangement the horsepower limiting control apparatus can be connected directly to the pump so as to utilize the flow of pumped fluid from the pump to load as the medium that is measured for limiting the horsepower required by the pump assembly.

An adjustable pilot means can be used in conjunction with the horsepower limiting control apparatus for setting the minimum pressure at which it becomes operational, and thereby the horsepower that can be transmitted to the load. If desired, the apparatus can be directly operated without the adjustable pilot means.

In a preferred form, the horsepower limiting control apparatus includes a variable orifice means that has a valve body that defines a bore, and inlet passageway in communication with the bore and with the pump for receiving the pump fluid, and an outlet passageway in communication with the bore for discharging the pumped fluid to load, a sleeve mounted on the bore at the outlet passageway and having a portion defining the orifice, a spool axially moveable in the bore to vary the effective size of the orifice and thereby the effective area for flow of the fluid, and biasing means for urging the spool axially in one direction to the position for providing maximum open area of the orifice for flow of fluid to the outlet passageway, the spool being responsive to pressure of the fluid in the inlet passageway to move axially in the other direction to reduce the area of the orifice for flow of fluid. In this arrangement, either the shape of the orifice, the characteristics of the spring or a combination of the two are utilized to determine the magnitude of the horsepower that is transmitted in response to the pressure of the fluid to load. Thus, regulating either the shape of the orifice or spring characteristics of the biasing spring is used to provide a desired area of the orifice for any specific flow rate and pressure of the fluid from the pump to the load. Since the area will then control the quantity of fluid flowing, and since the horsepower is a function of the pressure times the quantity of fluid flowing, the area of the orifice for any designated pressure of the fluid will limit the horsepower to a designated value for that selected area of the orifice.

Thus, it is the primary object of the present invention to provide an improved horsepower limiting control apparatus for a flow compensated variable displacement pump assembly in which the apparatus can be utilized directly with any existing flow compensated variable displacement pump assembly without modifying or altering the construction of the pump assembly.

Other objects of this invention will appear in the following description and appended claims, reference being had to the accompanying drawings forming a part of this specification wherein like reference characters designate corresponding parts in the several views.

BRIEF DESCRIPTION OF THE DRAWING

FIG. 1 is a schematic diagram of a pressure-flow compensated variable displacement pump assembly of a known type and a horsepower limiting control apparatus connected thereto and embodying one form of the present invention which is pilot controlled;

FIG. 2 is a section through the horsepower limiting control apparatus shown in FIG. 1; and FIG. 3 is a fragmentary section similar to FIG. 2, but showing horsepower limiting control apparatus that is directly controlled.

DESCRIPTION OF THE PREFERRED EMBODIMENT

Before explaining the present invention in detail, it is to be understood that the invention is not limited in its application to the details of construction and arrangement of parts illustrated in the accompanying drawing, since the invention is capable of other embodiments and of being practiced or carried out in various ways. Also, it is to be understood that the phraseology or terminology employed herein is for the purpose of description and not of limitation.

Referring now to the drawing, the invention will be described in greater detail. A pressure-flow compensated variable displacement pump assembly of a known type is shown at 10, and includes a variable displacement pump 12 that has its inlet suction port 14 connected to tank 16 and its outlet pressure port 18 connected to load 20, and it contains the camplate control piston 22 for setting the position of the camplate (not shown) and thereby the strokes of the pump pistons (not shown).

The pressure-flow compensated variable displacement pump assembly 10 includes a control to limit maximum pressure, and means to alter flow rates, but it does not match flow rates with maximum load pressure to limit horsepower required to drive the pump. The matching of available limited horsepower to load pressure requirements is carried out by the horsepower limiting control apparatus 24 as will subsequently be described.

The pump assembly 10 includes the pressure compensator 26 that limits the output pressure to a pre-set value under stall or maximum load conditions, and the flow compensator 28 adjusts pump flow to maintain a constant pressure drop across orifice means (to be described) at all conditions except when maximum pressure is reached.

The pressure compensator 26 eliminates the power loss due to excess flow, when a pre-set maximum pressure is reached, because it provides only the flow from the variable displacement pump 12 that is necessary to maintain this pre-set pressure at the outlet discharge port 18. The pressure at port 18 will then be at the setting of pressure compensator 26 regardless of the pressure that might be required to overcome the load. To accomplish this result, the pressure compensator 26 includes a valve 30 that is biased to the position illustrated in FIG. 1, in which the passageway 32, 34 from the discharge port 18 to the control piston 22 is blocked by the action of the variable spring means 36 which may be selectively pre-set at a desired setting, such as 3000 P.S.I., and the pilot line 38 will sense the pressure at discharge port 18 to urge the valve to an open position against the action of variable spring means 36 if the pressure exceeds 3000 P.S.I. The fluid in passageway 32, 34 will then act on the control piston 22 to change the position of the camplate (not shown) so as to change the flow of the fluid accordingly from the variable displacement pump 12.

The flow compensator 28 adjusts the pump flow to match the current variable orifice area values and adjusts the pump to whatever is required to maintain a constant pressure differential of a fixed magnitude, such as 200 P.S.I., for example, at the pump outlet port 18 above the pressure required by the load. To accomplish this result, the flow compensator 28 includes a valve 40 that is biased to the position illustrated in FIG. 1 and is pre-set by operation of spring 42 to provide a constant pressure differential across the valve of a magnitude such as 200 P.S.I.

The opposite ends of the valve 40 are responsive to the pressure of the fluid at pump outlet port 18 and at load 20, respectively, by virtue of the pilot lines 44 and 46; this arrangement, together with spring 42, assuring that a constant 200 P.S.I. differential is maintained between port 18 and load 20.

A passageway 48 extends between the valves 30 and 40 to allow drainage from camplate control piston 22 to discharge via passageway 34, 48 to tank 16 when both valves 30 and 40 are in their illustrated blocked positions. Further, when valve 30 is in its blocked position, which occurs when the pressure at discharge port 18 does not exceed 3000 P.S.I., the valve 40 will be responsive to a pressure drop of greater than 200 P.S.I. to move to an open position wherein fluid from pilot line 50 will flow to the camplate control piston 22 via valve 40, passageway 48, valve 30 and passageway 34 to change the position of the camplate (not shown) to reduce the flow of fluid from pump 12, and thereby to maintain the desired constant pressure differential of 200 P.S.I.

It is known in the art to conserve energy by employing the pressure and flow controls described above. With reference to FIGS. 1 and 2 the improved controls for use in conjunction therewith for conserving energy by limiting horsepower delivered by pump 12 to driver capacity will now be described.

The horsepower limiting control apparatus 24 includes the pressure regulated variable orifice means 52 which has a valve body 54 that defines a bore 56, an inlet passageway 58 in communication with said bore 56 and said pump 12 for receiving the pumped fluid, and an outlet passageway 60 in communication with said bore 56 for discharging the pumped fluid to load 20. A sleeve 62 is mounted in the bore 56 at said outlet passageway 60, and it has a portion defining at least one orifice 64 through which the main stream of fluid must pass when flowing through the orifice means 52. In this form of the invention, a sleeve 62 is used for manufacturing purposes, and primarily for making the orifice 64 of a predetermined shape and/or size. However, if desired, the orifice 64 can be provided in other ways such as by being machined in the valve body 54, without departing from the present invention.

A spool 66 is axially movable in the bore 56 to vary the effective size of the orifice 64 and thereby the effective area for flow of the fluid. Biasing means 68 urges the spool axially in one direction (to the left to FIG. 2) to the position providing maximum open area of the orifice 64 for flow of the fluid to the outlet passageway 60. The spool 66 is constructed in the conventional manner to have a greater area responsive to pressure of the fluid acting in the other direction (to the right in FIG. 2) to move the spool in said other direction to reduce the area of the orifice for flow of fluid.

The biasing means 68 can either include pilot operation or be only direct spring action. In the embodiment illustrated in FIGS. 1 and 2 of the drawings, the biasing means 68 is pilot operated by the pilot valve 69, and the biasing means 68 includes a coil spring 70 that is held in compression between the spool 66 and the rear wall 72 of the spring chamber 74, and vent ducts 76 and 78 are in spool 66 for flow of the fluid to opposite ends of spool 66 via the restricted orifice 80. The pilot valve 69 has a valve body 84 with a duct 86 in communication with spring chamber 74 and with passageway 88 via annular duct 90, radial duct 92, axial duct 94, relief valve element 96, and outlet duct 98. A compression spring 100 is mounted on relief valve element 96 and a variable spring load mechanism 102 of conventional construction is provided for selectively setting the spring load that must be overcome by the fluid pressure from spring chamber 74. By this arrangement, the initial pressure requirement to shift spool 66 to the right for restricting the effective area of variable orifice 64 can be set selectively by the operator, and thereby, the limit of horsepower is set that can be transmitted to load by the pump 12. When pressure relief is supplied by pilot valve 69, the fluid can flow from spring chamber 74 to tank 16 by way of passageway 88. All pressure values below the setting of pilot valve 69 result in fully balanced axial hydrostatic forces on spool 66 and the biasing means 68 prevents any movement to reduce the passage capacity of orifice 64.

As load resistance causes pressure rise above the setting of pilot valve 69, pressure in chamber 74 stops rising while pressure in passage 58 continues to rise. The resulting rising difference in these pressures can produce a force on spool 66 which increases until it overcomes the biasing spring 70. Spool 66 then moves to reduce the orifice passage capacity, tending to further increase pressures in passageway 58, which in turn causes valve 28 to effect a reduction in pump volume rate. These volume rate reductions attending these corresponding pressure increases can thus serve to limit rise in pump output and input horsepower so as not to overload the motor or engine driving the pump. This control can also be used to cause heavier loads to be moved proportionately slower in the interest of safety.

In the embodiment illustrated in FIG. 3 of the drawings, the biasing means 104 is in direct action. In this embodiment, the same parts as those shown in FIG. 2 have the same reference numbers and will not be described again. In the direct action embodiment, the characteristics of spring 70 will determine the pressure requirements of the fluid in passageway 58 that are required to shift spool 106 for varying the effective area of orifice 64. The fluid in duct 78 and the chambers at the ends of spool 106 (the one at the left in FIG. 3, not shown) are vented to atmospheric pressure via the drain line 108 to tank 16. The duct 76 has been eliminated so that the pressure in passageway 58 will now be exerted on the differential areas of spool 106 and the spring 70 for shifting spool 106 and thereby varying the area of orifice 64.

For the purpose of controlling the horsepower limiting characteristics of the control apparatus 24, the properties of spring 70 in combination wtih the configuration of orifice 64 may be selected in either the FIG. 2 or FIG. 3 embodiments so that the horsepower available from the pump driver is matched by the fluid supplied by pump 12. Any desired variation of both the spring 70 and orifice 64 may be employed.

It is claimed:

1. A horsepower limiting control apparatus for a variable displacement pump assembly that has a flow compensator for sensing the load pressure of the fluid and for adjusting the displacement of the pump to whatever is required to maintain a constant pressure differential of the fluid of a selected magnitude across the horsepower limiting control apparatus, characterized in that said horsepower limiting control apparatus, comprises a pressure regulated variable orifice means through the orifice of which said pumped fluid flows to the load, said variable orifice means being responsive to changes in pressure of the pumped fluid from the pump assembly to vary inversely the effective area of the orifice means, said flow compensator functioning to hold the pressure drop across said orifice means constant so that the flow across the orifice means also varies inversely with the pressure of the pumped fluid from the pump assembly thereby to limit to a preselected value the horsepower supplied by the pump assembly to load, and an adjustable pilot means is associated with said variable orifice means for setting selectively a minimum pressure of the fluid required to actuate said variable orifice means for reducing the effective area thereof and thereby to establish the upper limit of the horsepower that can be transmitted to load.

2. The horsepower limiting control apparatus that is defined in claim 1, characterized in that said variable orifice means includes a valve body that defines a bore, an inlet passageway in communication with said bore and with said pump for receiving the pumped fluid, and an outlet passageway in communication with said bore for discharging the pumped fluid to load, means associated with said bore defining said orifice, a spool axially movable in said bore to vary the effective size of the orifice and thereby the effective area for flow of the fluid, and biasing means for urging said spool axially in one direction to the position providing maximum open area of the orifice for flow of fluid to the outlet passageway, said spool being responsive to pressure of the fluid in said inlet passageway to move axially in the other direction to reduce the area of the orifice for flow of fluid.

3. The horsepower limiting control apparatus that is defined in claim 2, characterized in that the last-named means is a sleeve mounted in said bore.

4. The horsepower limiting control apparatus that is defined in claim 3, characterized in that said biasing means includes a spring having preselected spring characteristics for urging said spool in said one direction so that the orifice will be opened a preselected amount in response to a designated pressure of the fluid.

5. The horsepower limiting control apparatus that is defined in claim 3, characterized in that said orifice has a preselected shape of a configuration so that the effective area of the orifice at any location of the spool multiplied by the pressure of the fluid in said inlet passageway necessary to displace the spool to that location is substantially equal to a constant.

6. A horsepower limiting control apparatus for a variable displacement pump assembly that has a flow compensator for sensing the load pressure of the fluid and for adjusting the displacement of the pump to whatever is required to maintain a constant pressure differential of the fluid of a selected magnitude across the horsepower limiting control apparatus, characterized in that said horsepower limiting control apparatus comprises a pressure regulated variable orifice means through the orifice of which said pumped fluid flows to the load, said variable orifice means being responsive to changes in pressure of the pumped fluid from the pump assembly to vary inversely the effective area of the orifice means, said flow compensator functioning to hold the pressure drop across said orifice means constant so that the flow across the orifice means also varies inversely with the pressure of the pumped fluid from the pump assembly thereby to limit to a preselected value the horsepower supplied by the pump assembly to load, said variable orifice means including a valve body that defines a bore, an inlet passageway in communication with said bore and with said pump for receiving the pumped fluid, and an outlet passageway in communication with said bore for discharging the pumped fluid to load, means associated with said bore defining said orifice, a spool axially movable in said bore to vary the effective size of the orifice and thereby the effective area for flow of the fluid, and biasing means for urging said spool axially in one direction to the position providing maximum open area of the orifice for flow of fluid to the outlet passageway, said spool being responsive to pressure of the fluid in said inlet passageway to move axially in the other direction to reduce the area of the orifice for flow of fluid, and an adjustable pilot means is associated with said spool for setting selectively a minimum pressure of the fluid in the inlet passageway required to initiate axial movement of said spool in said other direction.

7. The horsepower limiting control apparatus that is defined in claim 6, characterized in that the last-named means is a sleeve mounted in said bore.

8. The horsepower limiting control apparatus that is defined in claim 6, characterized in that said biasing means includes a spring having preselected spring characteristics for urging said spool in said one direction so that the orifice will be opened a preselected amount in response to a designated pressure of the fluid.

9. A horsepower limiting control apparatus for a variable displacement pump assembly that has a flow compensator for sensing the load pressure of the fluid and for adjusting the displacement of the pump to whatever is required to maintain a constant pressure differential of the fluid of a selected magnitude across the horsepower limiting control apparatus, characterized in that said horsepower limiting control apparatus comprises a pressure regulated variable orifice means through the orifice of which said pumped fluid flows to the load, said variable orifice means being responsive to changes in pressure of the pumped fluid from the pump assembly to vary inversely the effective area of the orifice means, said flow compensator functioning to hold the pressure drop across said orifice means constant so that the flow across the orifice means also varies inversely with the pressure of the pumped fluid from the pump assembly thereby to limit to a preselected value the horsepower supplied by the pump assembly to load, said variable orifice means including a valve body that defines a bore and with said pump for receiving the pumped fluid, and an outlet passageway in communication with said bore for discharging the pumped fluid to load, means associated with said bore defining said orifice, a spool axially movable in said bore to vary the effective size of the orifice and thereby the effective area for flow of the fluid, and biasing means for urging said spool axially in one direction to the position providing maximum open area of the orifice for flow of fluid to the outlet passageway, said spool being responsive to pressure of the fluid in said inlet passageway to move axially in the other direction to reduce the area of the orifice for flow of fluid, said orifice having a preselected shape of a configuration so that the effective area of the orifice at any location of the spool multiplied by the pressure of the fluid in said inlet passageway necessary to displace the spool to that location is substantially equal to a constant, and an adjustable pilot means is associated with said spool for setting selectively a minimum pressure of the fluid in the inlet passageway required to initiate axial movement of said spool in said other direction.

10. The horsepower limiting control apparatus that is defined in claim 9, characterized in that said pilot means is in communication with the fluid in said inlet passageway for sensing the pressure of the fluid.

* * * * *